US008233829B2

(12) United States Patent
Miyazaki

(10) Patent No.: US 8,233,829 B2
(45) Date of Patent: Jul. 31, 2012

(54) TRANSFER BELT UNIT AND IMAGE FORMING APPARATUS

(75) Inventor: Takafumi Miyazaki, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 765 days.

(21) Appl. No.: 11/683,578

(22) Filed: Mar. 8, 2007

(65) Prior Publication Data

US 2007/0231023 A1 Oct. 4, 2007

(30) Foreign Application Priority Data

Mar. 28, 2006 (JP) ..... 2006-088482

(51) Int. Cl.
*G03G 15/01* (2006.01)

(52) U.S. Cl. ..... 399/299; 399/302; 399/308; 399/313

(58) Field of Classification Search ..... 399/299, 399/300, 302, 308, 313
See application file for complete search history.

(56) References Cited

U.S. PATENT DOCUMENTS

| | | | | |
|---|---|---|---|---|
| 7,302,203 | B2 * | 11/2007 | Morimoto et al. | 399/101 |
| 2002/0085864 | A1 * | 7/2002 | Abe | 399/299 |
| 2006/0045594 | A1 * | 3/2006 | Yamada et al. | 399/358 |
| 2006/0083557 | A1 * | 4/2006 | Nakano et al. | 399/302 |
| 2006/0133871 | A1 * | 6/2006 | Ishida | 399/341 |
| 2006/0210326 | A1 | 9/2006 | Takehara et al. | |
| 2006/0210327 | A1 | 9/2006 | Iwakura et al. | |
| 2006/0257176 | A1 | 11/2006 | Kawasaki et al. | |

FOREIGN PATENT DOCUMENTS

| | | | |
|---|---|---|---|
| JP | 61-130972 | | 6/1986 |
| JP | 5-281775 | | 10/1993 |
| JP | 10-20685 | | 1/1998 |
| JP | 2002-207370 | | 7/2002 |
| JP | 2002-318494 | | 10/2002 |
| JP | 2003-091179 | | 3/2003 |
| JP | 2003066688 | A * | 3/2003 |
| JP | 2003-241539 | | 8/2003 |
| JP | 2005-037596 | | 2/2005 |
| JP | 2005-60038 | | 3/2005 |
| JP | 2006-018160 | | 1/2006 |
| JP | 2006-072247 | | 3/2006 |

OTHER PUBLICATIONS

Machine translation of JP2002-207370.*
U.S. Appl. No. 12/135,490, filed Jun. 9, 2008, Miyazaki et al.
Japanese Office Action issued Aug. 26, 2011, in Patent Application No. 2006-088482.
Japanese Office Action mailed May 11, 2012 for Japanese Application No. 2005-010216 (Publication No. 2006-088482).

* cited by examiner

*Primary Examiner* — Walter L Lindsay, Jr.
*Assistant Examiner* — Barnabas Fekete
(74) *Attorney, Agent, or Firm* — Oblon, Spivak, McClelland, Maier & Neustadt, L.L.P.

(57) ABSTRACT

A transfer belt unit satisfies the following conditions. An intermediate transfer belt has a thickness not less than 100 micrometers and not more than 200 micrometers, a tension not less than 80 N/m and not more than 180 N/m, and a tensile elastic modulus not less than 1000 megapascals and not more than 2000 megapascals. A secondary-transfer bias roller has an Asker C hardness not less than 35 degrees and not more than 50 degrees. Stretching rollers for stretching the intermediate transfer belt have an outer diameter not less than 6 millimeters.

12 Claims, 1 Drawing Sheet

TRANSFER BELT UNIT AND IMAGE FORMING APPARATUS

CROSS-REFERENCE TO RELATED APPLICATIONS

The present document incorporates by reference the entire contents of Japanese priority document, 2006-088482 filed in Japan on Mar. 28, 2006.

BACKGROUND OF THE INVENTION

1. Field of the Invention

The present invention relates to a transfer belt unit that includes a transfer belt and an image forming apparatus that includes the transfer belt unit.

2. Description of the Related Art

An electrophotographic image forming apparatus has been used in which a toner image formed on a photoconductor as an image carrier is primarily transferred onto an endless transfer belt, and the transferred toner image is carried by endless movement of the transfer belt, and secondarily transferred onto a recording medium.

In such an image forming apparatus, it is necessary to apply a tension to the transfer belt to endlessly move the transfer belt in a tensioned state, so that a toner image primarily transferred onto the transfer belt can be secondarily transferred onto the recording medium accurately. However, if the tension is applied at all times to the transfer belt, deformation of a fixing belt may occur in a portion with a small curvature factor when the apparatus stops. The deformation is referred to as curling.

Japanese Patent Application Laid-open No. S61-130972 discloses an apparatus including a mechanism that applies an appropriate tension to the transfer belt at the time of driving the apparatus, and loosening the tension applied to the transfer belt at the time of stopping the apparatus. By loosening the tension at the time of stopping the apparatus, it is possible to prevent curling that occurs in a portion with a small curvature factor when the apparatus stops.

However, a mechanism that adjusts the tension automatically is required to apply the appropriate tension at the time of driving the apparatus, and loosening the tension at the time of stopping the apparatus, which makes the apparatus complicated, and causes a cost increase.

Through extensive researches by the inventor of the present invention, it has been found that curling likely occurs as a tensile elastic stress of material of the transfer belt increases, and the occurrence of curling can be prevented by using a material having a lower tensile elastic stress without a mechanism for adjusting the tension.

If, however, a material having a lower tensile elastic stress is used for the transfer belt, cracking at the end of the belt or belt waving may occur depending on the settings. The cracking at the end of the belt means that an end of the transfer belt cracks because the end in the width direction of the transfer belt comes in contact with a regulating member that regulates the movement in an axial direction of the belt at an axial end of at least one of a plurality of stretching rollers. The belt waving means that the end of the belt comes in contact with the regulating member and deforms, which causes the transfer belt to become wavy on the downstream side from the contact portion in an endless moving direction.

SUMMARY OF THE INVENTION

It is an object of the present invention to at least partially solve the problems in the conventional technology.

According to an aspect of the present invention, a transfer belt unit includes a transfer belt that is endless and transfers a toner image transferred from an image carrier onto a transfer medium, a secondary transfer roller that is located to form a nip with the transfer belt at a position where the toner image is transferred onto the transfer medium, a plurality of stretching rollers that stretches the transfer belt, a drive unit that transmits a rotational driving force to at least one of the stretching rollers, and a regulating member that regulates axial movement of the transfer belt at an axial end of at least one of the stretching rollers. The transfer belt has a thickness not less than 100 micrometers and not more than 200 micrometers, a tension not less than 80 N/m and not more than 180 N/m, and a tensile elastic modulus not less than 1000 megapascals and not more than 2000 megapascals. The tension is obtained by dividing a tension [N] applied in an endless moving direction of the transfer belt by a belt width [m] which is a length of the transfer belt in a direction perpendicular to the endless moving direction. The secondary transfer roller has an Asker C hardness not less than 35 degrees and not more than 50 degrees. The stretching rollers have an outer diameter not less than 6 millimeters.

According to another aspect of the present invention, an image forming apparatus includes an image forming unit and a transfer belt unit. The image forming unit includes a plurality of image carriers, a writing unit that writes a latent image on the image carriers, and a developing unit that forms a toner image from the latent image on the image carriers. The transfer belt unit includes a transfer belt that has an endless surface onto which the toner image is transferred from each of the image carriers at primary transfer positions corresponding to the image carriers, and transfers the toner image onto a transfer medium at a secondary transfer position, a secondary transfer roller that is located to form a nip with the transfer belt at the secondary transfer position, a plurality of stretching rollers that stretches the transfer belt, a drive unit that transmits a rotational driving force to at least one of the stretching rollers, and a regulating member that regulates axial movement of the transfer belt at an axial end of at least one of the stretching rollers. The transfer belt has a thickness not less than 100 micrometers and not more than 200 micrometers, a tension not less than 80 N/m and not more than 180 N/m, and a tensile elastic modulus not less than 1000 megapascals and not more than 2000 megapascals. The tension is obtained by dividing a tension [N] applied in an endless moving direction of the transfer belt by a belt width [m] which is a length of the transfer belt in a direction perpendicular to the endless moving direction. The secondary transfer roller has an Asker C hardness not less than 35 degrees and not more than 50 degrees. The stretching rollers have an outer diameter not less than 6 millimeters.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained below in detail with reference to the accompanying drawings.

Figure 1:
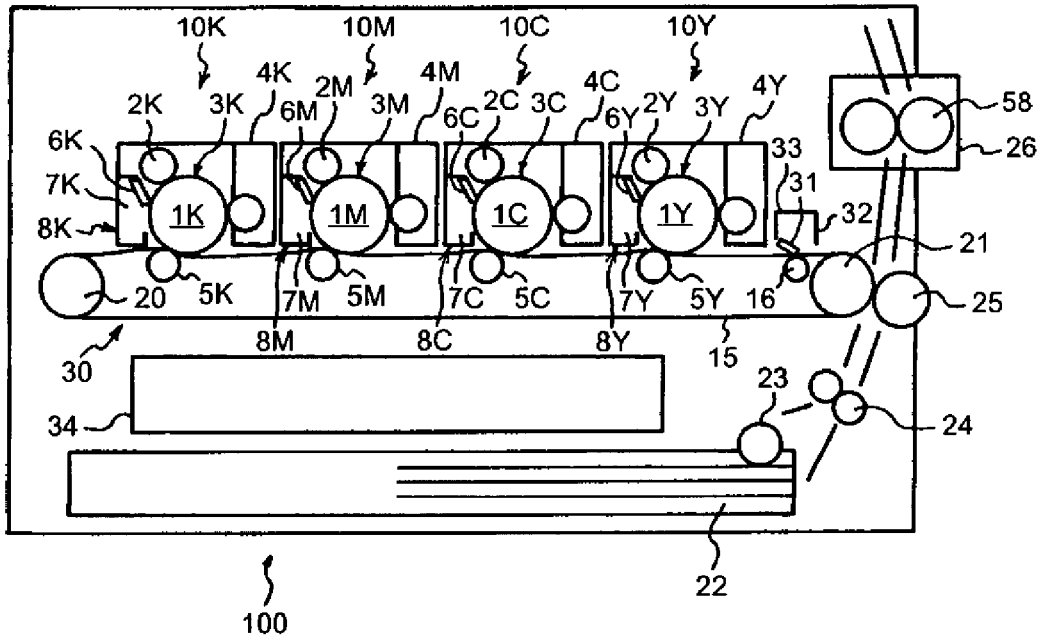
FIG. 1 is a schematic block diagram of relevant parts of a printer according to an embodiment of the present invention.

FIG. 1 is a schematic block diagram of an example of a printer 100 as an image forming apparatus according to an embodiment of the present invention The printer 100 is an electrophotographic tandem image forming apparatus of an intermediate transfer system and includes four photoconductor drums as image carriers.

The printer 100 includes four process cartridges 10Y, 10M, 10C, and 10K for forming yellow, magenta, cyan, and black (Y, M, C, and K) toner image above an intermediate transfer belt 15. The process cartridges use different Y, M, C, and K color toners as an image forming material. However, the process cartridges have an identical configuration except of the colors, and the cartridges are replaced when the toner in a development apparatus has been consumed, or a service life of a part forming the process cartridge 10 ends. These process cartridges 10 include a photoconductor drum 1Y, 1M, 1C, or 1K, respectively. Letters Y, C, M, and K added to reference numerals indicate yellow, cyan, magenta, and black, respectively. These photoconductor drums 1Y, 1M, 1C, and 1K are arranged so that a rotation axis thereof is in a horizontal direction, and the photoconductor drums face a back and forth direction of the apparatus (normal direction to the page in FIG. 1). The photoconductor drums are also arranged so that the respective rotation axes are positioned on the same horizontal plane, and are parallel to each other. In the present embodiment, the respective photoconductor drums 1Y, 1M, 1C, and 1K have a cylindrical shape having a diameter of 24 millimeters and are set to rotate at a circumferential velocity of 120 mm/sec.

Chargers 2Y, 2M, 2C, and 2K for uniformly charging the surfaces of the photoconductor drums are respectively provided around the respective photoconductor drums 1Y, 1M, 1C, and 1K. The chargers 2Y, 2M, 2C, and 2K are contact type charging units that respectively charge the surfaces of the photoconductor drums by bringing a charging roller rotating with the surface of the photoconductor drum into contact with each other. However, a non-contact type charging unit using a charger can be used. In the present embodiment, a DC bias or a bias in which an AC bias is superimposed on the DC bias is applied to the chargers 2Y, 2M, 2C, and 2K by a high-voltage power source (not shown) to charge so that surface potential of the respective photoconductor drums 1Y, 1M, 1C, and 1K becomes −500 volts uniformly.

An exposure device (not shown) as a latent image forming unit is arranged vertically above the photoconductor drums 1Y, 1M, 1C, and 1K. The exposure device irradiates the photoconductor drums 1Y, 1M, 1C, and 1K with light beams 3Y, 3M, 3C, and 3K, respectively, according to image information to form an electrostatic latent image of each color on each of the photoconductor drums 1Y, 1M, 1C, and 1K. A laser beam scanner using a laser diode can be used as the exposure device.

A transfer unit 30, i.e., a transfer belt unit including the intermediate transfer belt 15 as an endless transfer belt, is arranged vertically below the process cartridges 10Y, 10M, 10C, and 10*k*. The transfer unit 30 includes, in addition to the intermediate transfer belt 15, a tension roller 20, four primary-transfer bias rollers 5Y, 5M, 5C, and 5K as primary transfer rollers, a secondary-transfer opposing roller 21, and a belt cleaning unit 33. The transfer unit 30 is detachably formed relative to the printer 100, thereby enabling replacement of consumable parts at the same time.

Developing units 4Y, 4M, 4C, and 4K that develop the electrostatic latent image respectively formed on the surface of the photoconductor drum are provided around the respective photoconductor drums 1Y, 1M, 1C and 1K. A toner in a developer carried on a developing roller as a developer carrier in the respective developing units 4Y, 4M, 4C, and 4K is shifted to the electrostatic latent image on the photoconductor drums 1Y, 1M, 1C, and 1K by applying a predetermined developing bias from the high-voltage power source (not shown) to the developing roller, thereby allowing the toner to adhere on the electrostatic latent image. Accordingly, a toner image corresponding to the electrostatic latent image is respectively formed on the photoconductor drums 1Y, 1M, 1C, and 1K. 180 grams of one-component developer is stored in the developing unit at an initial stage of use.

The toner images of respective colors on the respective photoconductor drums 1Y, 1M, 1C, and 1K respectively developed by the developing units 4Y, 4M, 4C, and 4K are primarily transferred onto the intermediate transfer belt 15, which is an intermediate transfer member, and superposed on each other. The intermediate transfer belt 15 is spanned over a plurality of stretching rollers such as the secondary-transfer opposing roller 21 that forms a secondary transfer member, the primary-transfer bias rollers 5Y, 5M, 5C, and 5K that form a primary transfer member, and the tension roller 20. In the embodiment, a rotational driving force from a driving source as a driving unit (not shown) is transmitted to the secondary-transfer opposing roller 21 to rotate the secondary-transfer opposing roller 21, and hence the intermediate transfer belt 15 endlessly moves. That is, in the embodiment, the secondary-transfer opposing roller 21 is a driving roller of the intermediate transfer belt 15. Other stretching rollers can be used as the driving roller. A roller 16 as a cleaning opposing roller is arranged to oppose the belt cleaning unit 33. The respective rollers stretching the intermediate transfer belt 15 are supported by a side plate of the transfer unit 30 at opposite ends in the axial direction.

As the secondary-transfer opposing roller 21, which is the driving roller, polyurethane rubber (thickness from 0.3 millimeter to 1 millimeter), a thin layer coating roller (thickness from 0.03 millimeter to 0.1 millimeter), or the like can be used. In the embodiment, a urethane coating roller (thickness of 0.05 millimeter and diameter of 20 millimeters) is used, which has a small diameter change due to temperature.

Figure 2:
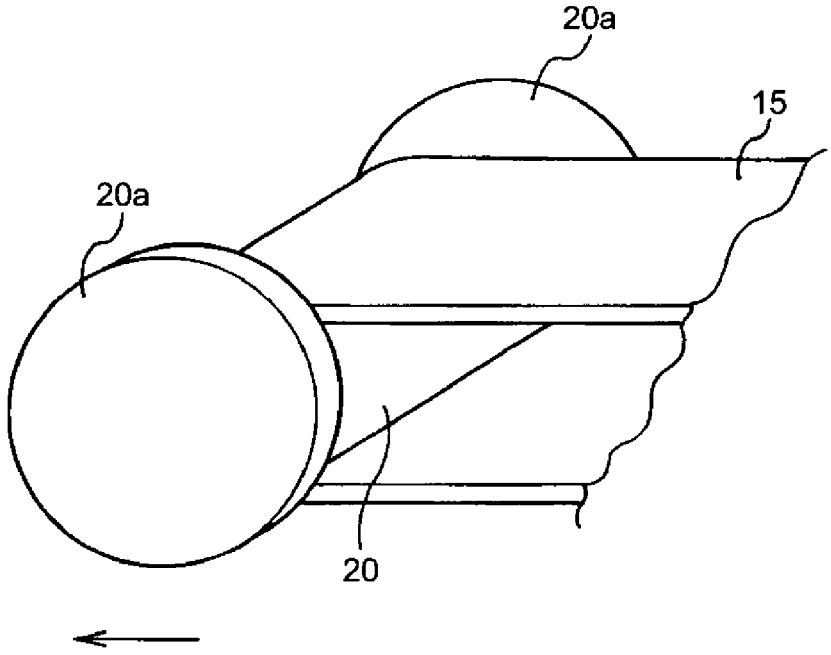
FIG. 2 is an enlarged schematic of periphery of a tension roller of a transfer unit shown in FIG. 1.

FIG. 2 is an enlarged view of periphery of the tension roller 20 of the transfer unit 30. The tension roller 20 is an aluminum pipe having a diameter of 20 millimeters, and a collar 20*a* having a diameter of 24 millimeters is press-fitted at the opposite ends of the tension roller 20. The collar 20*a* is a regulating member that prevents the intermediate transfer belt 15 moves in an axial direction of the tension roller 20 and meanders.

In the embodiment, the regulating member is provided only on the tension roller 20. However, the regulating member can be provided on the secondary-transfer opposing roller 21 or on the other stretching rollers.

As a material used for the intermediate transfer belt 15, a resin film endless belt can be used, in which a conductive material such as carbon black is dispersed in polyvinylidene difluoride (PVDF), ethylene-tetrafluoroethylene copolymer (ETFE), polyimide (PI), polycarbonate (PC), thermoplastic elastomer (TPE), or the like. In the embodiment, a belt having a single layer structure in which carbon black is added to TPE having a belt tensile elastic modulus of from 1000 megapascals to 2000 megapascals (tensile elastic modulus: measured in conformity with ISO R1184-1970, test piece: width of 15 millimeters and length of 150 millimeters, elastic stress rate: 1 mm/min, and distance between grippers: 100 millimeters), a thickness of from 100 micrometers to 200 micrometers, and a belt width of 230 millimeters.

As a resistance of the intermediate transfer belt 15, it is desired that volume resistivity is in a range of from $10^8$ to $10^{11}$ Ω·cm, and surface resistivity is in a range of from $10^8$ to $10^{11}$Ω/□ in an environment of 23° C. and 50% RH (both measured by HirestaUP MCP-HT450 by Mitsubishi Chemical Corporation, under a condition of applied voltage of 500 volts and application time of 10 seconds). If the volume resistivity and the surface resistivity of the intermediate transfer belt 15 exceed the range, the transfer bias needs to be increased, resulting in an increase in power cost. Further, because the intermediate transfer belt 15 is charged, a measure such as increasing a set voltage value is required on a downstream side of imaging. Therefore, a single power supply can be hardly used as the power supply for applying the voltage to the primary transfer member. This is because the charging potential of the intermediate transfer belt 15 increases due to application of the transfer bias, and self-discharge becomes difficult. As a measure against the disadvantage, a discharging mechanism for discharging the intermediate transfer belt 15 is required, which leads to a cost increase. On the other hand, if the volume resistivity and the surface resistivity fall below the above range, because the charging potential of the intermediate transfer belt 15 quickly attenuates, it is advantageous to discharge by self-discharge. However, because the transfer current flowing at the time of transfer likely flows in a surface direction, scattering of toner occurs. Accordingly, it is desired that the volume resistivity and the surface resistivity of the intermediate transfer belt 15 are in the above range.

There is an advantage by using TPE as the material for the intermediate transfer belt 15 in that a balance between the surface resistivity and the volume resistivity as the electrical resistance can be easily adjusted, while satisfying the range of the belt elastic modulus. Because the surface resistivity and the volume resistivity can be adjusted to a desired balance, excellent transfer can be performed. Further, because the adjustment is relatively easy, cost reduction can be achieved.

As the primary transfer member facing the photoconductor drums 1Y, 1M, 1C, and 1K with the intermediate transfer belt 15 therebetween, a conductive blade, a conductive sponge roller, or a metal roller can be used. In the embodiment, the primary-transfer bias rollers 5Y, 5M, 5C, and 5K made of metal having a diameter of 8 millimeters are used. The primary-transfer bias rollers 5Y, 5M, 5C, and 5K are offset relative to the photoconductor drums 1Y, 1M, 1C, and 1K by 8 millimeters in a moving direction of the intermediate transfer belt 15 and 1 millimeter vertically upwards. A transfer electric field is formed between the intermediate transfer belt 15 and the photoconductor drums 1Y, 1M, 1C, and 1K by commonly applying a predetermined primary transfer bias of from +500 to +1000 volts to the primary-transfer bias rollers 5Y, 5M, 5C, and 5K by a primary transfer power source (not shown), so that the toner image on the photoconductor is electrostatically transferred to the intermediate transfer belt 15.

Each of cleaning devices 8Y, 8M, 8C, and 8K as an image carrier cleaning unit for removing residual toner after transfer remaining on the photoconductor drum after primary transfer is provided around each of the photoconductor drums 1Y, 1M, 1C, and 1K. The cleaning devices 8Y, 8M, 8C, and 8K include cleaning blade 6Y, 6M, 6C, and 6K as a removing member, and first waste toner-collecting units 7Y, 7M, 7C, and 7K, respectively. Each of the cleaning blades 6Y, 6M, 6C, and 6K abuts the back of each photoconductor to scrape and remove the residual toner on the surface of the photoconductor drum. The residual toners having removed by the cleaning blades 6Y, 6M, 6C, and 6K are collected by the first waste toner-collecting units 7Y, 7M, 7C, and 7K.

The toner image transferred on the intermediate transfer belt 15 is secondarily transferred onto transfer paper 22, which is a recording medium transferred to a secondary transfer area, in the secondary transfer area between the belt portion wound around the secondary-transfer opposing roller 21 and a secondary-transfer bias roller 25 as a secondary transfer roller. The toner image on the intermediate transfer belt 15 is electrostatically transferred onto a recording material by applying a predetermined secondary transfer bias to the secondary-transfer bias roller 25 by a high voltage power supply (not shown).

The secondary transfer bias roller 25 is formed by covering a metal core made of SUS or the like with an elastic layer such as urethane processed to have a resistance of from $10^6$ to $10^{10}$Ω by a conductive material. As materials thereof, an ion conductive roller (urethane+carbon dispersion, NBR, hydrin), an electron conductive roller (EPDM), and the like can be used. In the embodiment, a urethane roller as a foam roller having a diameter of 20 millimeters and an Asker C hardness of from 35 to 50 degrees is used.

Because a transfer current hardly flows when the resistance of the secondary-transfer bias roller 25 exceeds the above range, high voltage needs to be applied for obtaining necessary transferability, thereby increasing power cost. Because high voltage needs to be applied, discharge occurs in a gap in front of or behind the secondary transfer nip, and white spots due to the discharge appears on a halftone image. This phenomenon is noticeable in a low temperature and low humidity environment (for example, 10° C., 15% RH).

On the other hand, when the resistance of the secondary-transfer bias roller 25 falls below the above range, it is difficult to maintain excellent transferability both in an image area in which toner images of a plurality of colors present on the same image are superposed, and in a monochrome image area. This is because, since the resistance of the secondary-transfer bias roller 25 is low, if the secondary transfer bias is set to a relatively low voltage capable of obtaining an optimum transfer current for the monochrome image area, sufficient transfer current cannot be obtained for the color image area. On the contrary, if the secondary transfer bias is set to a relatively high voltage capable of obtaining an optimum transfer current for color image area, excessive transfer current flows to the monochrome image area, thereby decreasing transfer efficiency.

The resistance of the secondary-transfer bias roller 25 is calculated from a current value flowing at the time of applying a voltage of 1000 volts to between the core and a conductive metal plate in a state with a load of 4.9 Newtons being respectively applied to the opposite ends of the core (in total, 9.8 Newtons at the both ends), by installing the secondary-transfer bias roller 25 on the metal plate.

The transfer paper 22 is fed by a resist roller pair 24, matched with the timing at which the end of the toner image on the surface of the intermediate transfer belt 15 reaches the secondary transfer position, and the toner image on the intermediate transfer belt 15 is transferred onto the transfer paper 22 by applying the predetermined secondary transfer bias by the high voltage power supply (not shown). The transfer paper 22 is separated from the intermediate transfer belt 15 due to a curvature factor of the secondary-transfer opposing roller 21, and the transfer paper 22 is ejected after the toner image transferred onto the transfer paper 22 is fixed by a fuser 26 as a fixing unit.

The belt cleaning unit 33 as an intermediate transfer member-cleaning unit for removing the residual toner after transfer remaining on the intermediate transfer belt 15 after secondary transfer is arranged at a position facing the roller 16 with the intermediate transfer belt 15 therebetween. The belt cleaning unit 33 includes a cleaning blade 31 as a removing member and a second waste toner-collecting unit 32. The cleaning blade 31 abuts against the surface of the intermediate transfer belt 15, and scrapes and removes the residual toner on the intermediate transfer belt 15. The residual toner removed by the cleaning blade 31 is collected by the second waste toner-collecting unit 32, and carried to a waste toner container 34 via a toner carrier path (not shown) to be collected therein.

In the embodiment, there are a monochrome mode for forming an image of any one color of yellow, magenta, cyan, and black, a two-color mode for superposing any two colors of yellow, magenta, cyan, and black to form an image of two colors, a three-color mode for superposing any three colors of yellow, magenta, cyan, and black to form an image of three colors, and a full color mode for forming the four-color image described above, and these modes can be specified by an operation unit.

In the embodiment, the process speed at the time of fixing the toner image is changed according to the type of the transfer paper 22. Specifically, when the transfer paper 22 having a basis weight of 100 g/m$^2$ or more is used, the process speed is set to half speed. Accordingly, because the transfer paper 22 passes through the fixing nip formed by a fixing roller pair 58 in the fuser 26 over twice the time of the normal process speed, fixity of the toner image can be secured.

The transfer unit 30 in the embodiment integrally supports the intermediate transfer belt 15, the tension roller 20, the primary-transfer bias rollers 5Y, 5M, 5C, and 5K, the secondary-transfer opposing roller 21, and the belt cleaning unit 33, and is detachably formed relative to the printer 100, so that consumable parts can be replaced at the same time. The transfer unit 30 can have such a configuration that it also integrally supports the secondary-transfer bias roller 25 and is detachable relative to the printer 100.

[Experiment]

The transfer belt unit described above and the image forming apparatus using the same were evaluated by changing the belt thickness, belt tension, belt elastic modulus, diameter of the primary transfer roller, diameter of the cleaning opposing roller, and hardness of the secondary-transfer bias roller.

<Driving Test>

The intermediate transfer belt was continuously driven at a process speed of 120 mm/s to check the occurrence of cracking at the end of the belt and the occurrence of belt waving.

The defect of the cracking at the end of the belt is defined as cracking equal to or more than 1 millimeter visually confirmed at the end of the belt, and waving is defined as unevenness equal to or more than 1 millimeter visually confirmed on the surface of the belt at a position about 30 millimeters from the end of the belt. Because it was obvious that the primary transfer roller and the belt-cleaning opposing roller had a shallow angle of contact as shown in FIG. 1, and the outer diameters of these rollers did not largely affect the driving test result, a metal roller having a diameter of 8 millimeters was used for the both rollers.

The result of the driving test is shown in Table 1.

TABLE 1

| | Belt thickness | Belt tension | Tensile elastic modulus | Result | |
|---|---|---|---|---|---|
| | (μm) | (N/m) | (MPa) | Cracking | Waving |
| Example 1 | 150 | 130 | 1500 | ○ | ○ |
| Example 2 | 100 | 130 | 1500 | Δ | ○ |
| Example 3 | 200 | 130 | 1500 | ○ | Δ |
| Example 4 | 150 | 80 | 1500 | ○ | Δ |
| Example 5 | 150 | 180 | 1500 | Δ | ○ |
| Example 6 | 150 | 130 | 1000 | ○ | Δ |
| Example 7 | 150 | 130 | 2000 | Δ | ○ |
| Comparative Example 1 | 80 | 130 | 1500 | xx | — |
| Comparative Example 2 | 250 | 130 | 1500 | — | xx |
| Comparative Example 3 | 150 | 60 | 1500 | — | x |
| Comparative Example 4 | 150 | 200 | 1500 | x | — |
| Comparative Example 5 | 150 | 130 | 500 | — | xx |
| Comparative Example 6 | 150 | 130 | 2500 | x | — |

In Table 1, a transfer belt unit that suffered a defect within 50 hours of driving is indicated by "xx", the one that suffered a defect during 50 to 150 hours of driving is indicated by "x", the one that suffered a defect during 150 to 300 hours of driving is indicated by "A", the one that suffered no defect in 300 hours is indicated by "O", and the one that was not evaluated due to suspension of the driving evaluation is indicated by "-".

From Examples 1, 2, and 3, and Comparative Examples 1 and 2 in Table 1, it is seen that waving likely occurs as the thickness of the belt becomes thick, and on the contrary, cracking at the end of the belt likely occurs as the thickness of the belt becomes thin. This is because, as the thickness of the belt becomes thicker, the tension acting on a unit of volume of the belt decreases, and as the thickness of the belt becomes thinner, the tension acting on a unit of volume of the belt increases, in a state with the same tension being applied. It is conceived that, when the thickness of the belt is thick, and the tension acting on a unit of volume is small, the belt easily deforms in a relatively loose state, and when the belt comes in contact with the regulating member, the belt deforms to cause waving. On the other hand, when the thickness of the belt is thin, and the tension acting on a unit of volume is large, the belt hardly deforms in a relatively tensioned state, elastic deformation hardly occurs, and the belt is in a fragile state upon application of a force. Accordingly, when the belt comes in contact with the regulating member, the cracking at the end of the belt easily occurs.

From Examples 1, 4, and 5, and Comparative Examples 3 and 4 in Table 1, it is seen that waving easily occurs as the belt tension decreases, and on the contrary, the cracking at the end of the belt easily occurs as the belt tension increases. It is considered that this is because when the belt tension is small, the belt easily deforms in a relatively loose state, and when the belt comes in contact with the regulating member, the belt deforms to cause waving. On the other hand, when the belt tension is large, the belt hardly deforms in a relatively tensioned state, elastic deformation hardly occurs, and the belt is in a fragile state upon application of a force. Accordingly, when the belt comes in contact with the regulating member, the cracking at the end of the belt easily occurs.

From Examples 1, 6, and 7, and Comparative Examples 5 and 6 in Table 1, it is seen that waving easily occurs as the belt tensile elastic modulus decreases, and on the contrary, the cracking at the end of the belt easily occurs as the belt tensile elastic modulus increases. It is considered that this is because when the belt tensile elastic modulus is small, the belt easily deforms, and when the belt comes in contact with the regulating member, the belt deforms to cause waving. On the other hand, when the belt tensile elastic modulus is large, the belt hardly deforms and is in a fragile state, and when the belt comes in contact with the regulating member, the cracking at the end of the belt easily occurs.

<Storage Test>

As a storage test, after the image forming apparatus was left in an environment of 45° C. and 90% RH for two weeks, a single-color halftone image was printed at 600 dots per inch in an environment of 23° C. and 50% RH, and curling (lateral stripe) was checked. In the storage test, a transfer belt having a belt thickness of 150 micrometers, and a belt tensile elastic modulus of 1500 megapascals, which achieved an excellent result from the driving test for both "cracking" and "waving", was used as the transfer belt, to simplify the experiments.

The result of the storage test is shown in Table 2.

TABLE 2

| | Belt tension (N/m) | Diameter of primary-transfer bias roller (mm) | Diameter of cleaning opposing roller (mm) | Hardness of secondary-transfer bias roller (mm) | Result |
|---|---|---|---|---|---|
| Example 1 | 130 | 8 | 8 | 42 | ○ |
| Example 4 | 80 | 8 | 8 | 42 | ○ |
| Example 5 | 180 | 8 | 8 | 42 | Δ |
| Example 8 | 130 | 6 | 6 | 42 | Δ |
| Example 9 | 130 | 6 | 6 | 35 | Δ |
| Example 10 | 130 | 6 | 6 | 50 | Δ |
| Comparative Example 7 | 200 | 8 | 8 | 42 | x |
| Comparative Example 8 | 130 | 6 | 6 | 32 | x |
| Comparative Example 9 | 130 | 6 | 6 | 52 | x |

In Table 2, an apparatus in which a stripe was visually confirmed in an image is indicated by "x", the one in which curling was visually confirmed on the transfer belt but no stripe was visually seen in an image is indicated by "Δ", and the one in which no stripe is seen both on an image and on the transfer belt is indicated by "o".

From Examples 1, 4, and 5, and Comparative Example 7 in Table 2, it can be confirmed that curling likely occurs as the tension increases.

Further, from Examples 1 and 8 in Table 2, it can be confirmed that curling likely occurs as the roller diameter decreases.

From Examples 9 and 10 and Comparative Examples 8 and 9 in Table 2, it can be confirmed that even when the hardness of the secondary-transfer bias roller is too high or too low, a lateral stripe is generated on the image. If the secondary-transfer bias roller has high hardness, contactability between the roller and the belt decreases, and formation of the secondary transfer nip becomes unstable, thereby disturbing the image. In Comparative Example 9, curling of the transfer belt is sharply picked up, and results in a lateral stripe on the image. If the secondary-transfer bias roller has low hardness, the secondary-transfer bias roller itself deforms when being left as it is, thereby forming a lateral stripe on the image resulting from deformation of the secondary-transfer bias roller.

From these experiments, it has been found that all of curling of the belt, cracking at the end of the belt, and waving of the belt can be prevented by setting the thickness of the transfer belt in a range of 100 micrometers to 200 micrometers, belt tension in a range of 80 N/m to 180 N/m, belt tensile elastic modulus in a range of 1000 megapascals to 2000 megapascals, the outer diameter of all the rollers coming in contact with the belt at a belt contact portion to 6 millimeters or more, and the hardness of the secondary-transfer bias roller to Asker C hardness in a range of 35 degrees to 50 degrees.

Accordingly, the printer 100 as the image forming apparatus having high reliability can be provided by setting the intermediate transfer belt 15 and the secondary-transfer bias roller 25 as above. Further, in a configuration in which the transfer unit 30 integrally supports the secondary-transfer bias roller 25, the transfer unit 30 as the transfer belt unit having high reliability can be provided by setting the intermediate transfer belt 15 and the secondary-transfer bias roller 25 as above.

As set forth hereinabove, according to an embodiment of the present invention, the occurrence of curling, cracking at the end of the belt, and waving of the belt can be reduced if the following conditions are satisfied:

The intermediate transfer belt has a belt thickness in a range from 100 micrometers to 200 micrometers, belt tension from 80 N/m to 180 N/m, and tensile elastic modulus from 1000 megapascals to 2000 megapascals.

The secondary transfer roller has an Asker C hardness of 35 degrees to 50 degrees.

The outer diameter of the stretching rollers for stretching the intermediate transfer belt is equal to or larger than 6 millimeters.

Thus, the image forming apparatus having high reliability can be realized. In the configuration in which the transfer unit integrally supports the secondary-transfer bias roller, the transfer unit as the transfer belt unit having high reliability can be realized. Additionally, an inexpensive intermediate transfer belt that satisfies the above belt tensile elastic modulus can be obtained by using thermoplastic elastomer (TPE) as the material of the intermediate transfer belt.

Moreover, by using metal rollers for the primary-transfer bias rollers of the stretching rollers, the manufacturing cost can be reduced as compared to an instance in which rollers having a resin layer is used. Besides, through the use of a urethane roller, i.e., a foam roller having an Asker C hardness of not less than 35 degrees and not more than 50 degrees, as a secondary transfer roller, a secondary transfer nip suitable for image formation can be formed. Thus, an excellent image can be obtained.

Furthermore, the primary-transfer bias rollers are arranged offset with respect to the photoconductor drums. Therefore, a primary transfer nip can be formed stably and primary transfer can be performed favorably, resulting in excellent image quality.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A transfer belt unit, comprising:

a transfer belt that is endless and transfers a toner image transferred from an image carrier onto a transfer medium;

a secondary transfer roller that forms a nip with the transfer belt at a position where the toner image is transferred onto the transfer medium;

a plurality of stretching rollers that stretches the transfer belt;

a drive unit that transmits a rotational driving force to at least one of the stretching rollers;

a regulating member that prevents axial movement of the transfer belt at an axial end of at least one of the stretching rollers by having a diameter substantially 20% larger than a diameter of the stretching rollers at an end of the transfer belt where the regulating member contacts the transfer belt; and a primary transfer roller that faces the image carrier via the transfer belt, the primary transfer roller being offset with respect to the image carrier, wherein the transfer belt has a thickness not less than 100 micrometers and not more than 200 micrometers, a tension not less than 80 N/m and not more than 180 N/m, and a tensile elastic modulus not less than 1000 megapascals and not more than 2000 megapascals, the tension being obtained by dividing a tension [N] applied in an endless moving direction of the transfer belt by a belt width [m], which is a length of the transfer belt in a direction perpendicular to the endless moving direction, the secondary transfer roller has an Asker C hardness not less than 35 degrees and not more than 50 degrees, the stretching rollers have an outer diameter not less than 6 millimeters, and the primary transfer roller is a metal roller without a resin layer on a surface thereof.

2. The transfer belt unit according to claim 1, wherein the transfer belt is made of a thermoplastic elastomer.

3. The transfer belt unit according to claim 1, wherein at least one of the stretching rollers is a metal roller.

4. The transfer belt unit according to claim 1, wherein the stretching rollers include a tension roller, and the regulating member is provided at an axial end of the tension roller.

5. The transfer belt unit according to claim 2, wherein the transfer belt has a volume resistivity of $10^8$ to $10^{11}$ Ω·cm and a surface resistivity of $10^8$ to $10^{11}$Ω/□.

6. The transfer belt unit according to claim 1, wherein the secondary transfer roller also includes the regulating member.

7. An image forming apparatus comprising:

an image forming unit that includes:

a plurality of image carriers, a writing unit that writes a latent image on the image carriers, and a developing unit that forms a toner image from the latent image on the image carriers; and a transfer belt unit that includes:

a transfer belt that has an endless surface onto which the toner image is transferred from each of the image carriers at primary transfer positions corresponding to the image carriers, and transfers the toner image onto a transfer medium at a secondary transfer position;

a secondary transfer roller that forms a nip with the transfer belt at the secondary transfer position;

a plurality of stretching rollers that stretches the transfer belt;

a drive unit that transmits a rotational driving force to at least one of the stretching rollers, a regulating member that prevents axial movement of the transfer belt at an axial end of at least one of the stretching rollers by having a diameter substantially 20% larger than a diameter of the stretching rollers at an end of the transfer belt where the regulating member contacts the transfer belt; and primary transfer rollers that face the image carriers via the transfer belt and form the primary transfer positions, the primary transfer rollers being offset with respect to the image carriers, wherein the transfer belt has a thickness not less than 100 micrometers and not more than 200 micrometers, a tension not less than 80 N/m and not more than 180 N/m, and a tensile elastic modulus not less than 1000 megapascals and not more than 2000 megapascals, the tension being obtained by dividing a tension [N] applied in an endless moving direction of the transfer belt by a belt width [m] which is a length of the transfer belt in a direction perpendicular to the endless moving direction, the secondary transfer roller has an Asker C hardness not less than 35 degrees and not more than 50 degrees, the stretching rollers have an outer diameter not less than 6 millimeters, and the primary transfer rollers are metal rollers without resin layers on surfaces thereof.

8. The image forming apparatus according to claim 7, wherein the transfer belt is made of a thermoplastic elastomer.

9. The image forming apparatus according to claim 7, wherein at least one of the stretching rollers is a metal roller.

10. The image forming apparatus according to claim 7, wherein the stretching rollers include a tension roller, and the regulating member is provided at an axial end of the tension roller.

11. The image forming apparatus according to claim 8, wherein the transfer belt has a volume resistivity of $10^8$ to $10^{11}$ Ω·cm and a surface resistivity of $10^8$ to $10^{11}$Ω/□.

12. The image forming apparatus according to claim 7, wherein the secondary transfer roller also includes the regulating member.

* * * * *